US006366252B1

(12) United States Patent
Terk

(10) Patent No.: US 6,366,252 B1
(45) **Date of Patent: *Apr. 2, 2002**

(54) METHOD AND APPARATUS FOR MOUNTING AN AUXILIARY ANTENNA TO A REFLECTOR ANTENNA

(75) Inventor: Neil D. Terk, 1 Vista Dr., Laurel Hollow, NY (US) 11791

(73) Assignee: Neil D. Terk, Laurel Hollow, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/624,687

(22) Filed: Jul. 24, 2000

(51) Int. Cl.[7] ..... H01Q 21/00
(52) U.S. Cl. ..... 343/725; 343/727; 343/880
(58) Field of Search ..... 343/725, 727, 343/700 MS, 741, 786, 792.5, 866, 895, 878, 879, 880, 840, 892, 912

(56) References Cited

U.S. PATENT DOCUMENTS

| | | | | |
|---|---|---|---|---|
| 1,283,451 A | | 11/1918 | Bale | |
| 2,653,238 A | | 9/1953 | Bainbridge | |
| 4,198,639 A | * | 4/1980 | Killion | 343/727 |
| 4,380,014 A | | 4/1983 | Howard | |
| 4,388,624 A | | 6/1983 | Dupressoir | |
| 4,544,928 A | | 10/1985 | Afifi et al. | |
| 4,792,815 A | | 12/1988 | Moisdon | |
| 4,825,218 A | | 4/1989 | Begout et al. | |
| 4,989,014 A | | 1/1991 | Kocsi | |
| 5,276,904 A | | 1/1994 | Mutzig et al. | |
| 5,451,969 A | | 9/1995 | Toth et al. | |
| 5,604,508 A | | 2/1997 | Atkinson | |
| 5,606,334 A | | 2/1997 | Amarillas et al. | |
| 5,617,107 A | * | 4/1997 | Fleming | 343/704 |
| 5,793,336 A | | 8/1998 | Shoemaker et al. | |
| 5,812,096 A | | 9/1998 | Tilford | |
| 5,880,699 A | | 3/1999 | McCorkle | |
| 5,929,818 A | | 7/1999 | Snyder | |
| 5,933,123 A | | 8/1999 | Kaul | |
| 5,999,137 A | | 12/1999 | Crosby | |
| 6,067,051 A | | 5/2000 | Terk et al. | |
| 6,127,982 A | * | 10/2000 | Terk | 343/725 |
| 6,138,998 A | * | 10/2000 | Parker et al. | 267/140.15 |
| 6,166,703 A | * | 12/2000 | Muterspaugh | 343/840 |

* cited by examiner

*Primary Examiner*—Tho Phan
(74) *Attorney, Agent, or Firm*—Hoffmann & Baron, LLP

(57) ABSTRACT

An antenna subassembly includes a terrestrial and/or satellite auxiliary antenna and a support that mounts the auxiliary antenna to a reflector of a dish antenna. The support can be used to removably affix and position a wide variety of antennas to the dish antenna via magnetic attraction. The support preferably conforms to at least a portion of the dish antenna.

25 Claims, 13 Drawing Sheets

METHOD AND APPARATUS FOR MOUNTING AN AUXILIARY ANTENNA TO A REFLECTOR ANTENNA

BACKGROUND OF THE INVENTION

1. Field of the Invention

This invention relates generally to antennas, and more particularly to the mounting of an auxiliary terrestrial and/or satellite antenna on a reflector antenna.

2. Description of the Prior Art

Satellite dish or reflector antennas have gained popularity, in part, for their ability to provide television programming from a number of sources greater than that available from local, terrestrial VHF and UHF stations. However, such dish antennas are adapted to receive video signals from satellites disposed in synchronous or stationary orbits about the earth to the exclusion of locally transmitted VHF and UHF signals. To enable reception of locally transmitted video signals and locally produced television programs, it is necessary to also employ an antenna that is adapted to receive signals in other bands, such as VHF and UHF.

U.S. Pat. No. 5,606,334 to Amarilllas, et al. is directed to the combination of a compact, rectangularly-shaped assembly of a reflector or dish antenna with fragmented curved surfaces and a VHF/UHF antenna, which is mounted on the reflector. An amplifier processes the signals from the reflector and its waveguide. The VHF/UHF antenna is mounted along the periphery of the reflector.

U.S. Pat. No. 5,793,336 to Shoemaker, et al. is directed to the combination of two antennas. The first antenna includes a nonconductive layer, on which first and second radiators are deposited. The second antenna is a double-curved dish. The first antenna is disposed in a housing, which includes a back plate. The plate is mounted to the back of the double-curved dish.

Neither of the patents discussed above deals with the needs or problems presented by the after-market, where it is often desirable to retrofit dish antennas that have already been installed. Of course, a second antenna could be installed at the expense of the aesthetic appearance of the structure, e.g., a residence, to which two antennas are mounted.

In U.S. Pat. No. 5,929,818 to Snyder, an assembly having a dish antenna and a UHF/VHF antenna, which includes two dipoles, is disclosed. The dipoles are bent into a shape that is similar to that of the dish.

The television signals from the satellite source and the terrestrial source are outputted from the satellite dish antenna and the UHF/VHF antenna, respectively. The television signals may be transmitted by coaxial cable in a variety of ways to a satellite receiver. The satellite receiver is disposed within a building or home, on which the antenna assembly is mounted. As is well known in the art, the satellite receiver performs a number of functions. First, the receiver demodulates the television signal before feeding it to the display for viewing. Second, the satellite receiver provides a selective switching function, which enables the viewer to select which of the satellite or terrestrial signals is to be displayed.

In one mode, two coaxial cables are coupled between the satellite receiver and the antenna assembly. In a second mode, a pair of diplexors enables a single coaxial cable to carry both satellite and terrestrial signals to the satellite receiver. In this mode, the cable from the UHF/VHF antenna is coupled to the UHF/VHF terminal of the diplexor, and the cable from the satellite dish antenna is coupled to a satellite terminal on the diplexor.

Amplifiers are available to improve fringe area reception of the UHF/VHF transmission signal. It is to be appreciated that the satellite receiver is designed to provide sufficient amplification to the satellite television signal without the use of an additional amplifier. Where two coaxial cables are used to transmit the terrestrial and satellite signals to the satellite receiver, a UHF/VHF amplifier is inserted in series with the UHF/VHF cable. Where only a single cable is used to carry the terrestrial and satellite signals and two diplexors are used, the UHF/VHF amplifier is connected in series between the second diplexor, which is disposed within the structure, and the satellite receiver. However, the installation of the diplexors and the UHF/VHF amplifiers is complicated by the use of two cables or, in the alternative, the incorporation of two diplexors. In addition, the method of mounting the UHF/VHF antenna to the dish antenna disclosed in the Snyder patent does not permit it to be easily removed from or relocated on the dish antenna without a significant amount of effort by the consumer.

OBJECTS AND SUMMARY OF THE INVENTION

It is an object of the present invention to provide an antenna subassembly that can readily be mounted to and repositioned on a dish antenna.

It is a further object of the present invention to provide an antenna subassembly in which one or more different types of satellite and/or terrestrial antennas can be magnetically mounted to a dish antenna in user-selectable orientations with respect to the dish antenna.

It is still a further object of the present invention to provide an antenna assembly that can be connected to a satellite receiver using a minimum number of cables without requiring additional electrical and/or mechanical devices.

It is yet a further object of the present invention to provide an antenna assembly including one or more different types of satellite and/or terrestrial antennas magnetically mounted to a dish antenna in user-selectable orientations with respect to the dish antenna.

In accordance with the present invention, an antenna assembly includes a dish antenna having a reflector, a support magnetically affixed to the reflector, and an auxiliary or second antenna affixed to the support. The reflector has a front signal-receiving surface and a rear surface. At least a portion of the rear surface is metallic or capable of magnetic attraction. At least a portion of the support is also metallic or magnetic. The auxiliary antenna is coupled to the support, which enables it to be removably affixed and selectively positioned on the reflector via magnetic attraction between the support and the rear surface of the reflector. An adjustable mounting device, such as a captive-ball mount, may be disposed between the support and the auxiliary antenna to permit additional selective positioning of the auxiliary antenna in at least one plane. The antenna assembly may also be a subassembly, which preferably includes only the support and the auxiliary antenna. Such an antenna subassembly may be used to retrofit existing dish antennas.

In further accordance with the present invention, an antenna subassembly includes the auxiliary satellite and/or terrestrial antenna, a power amplifier, and a diplexor. The auxiliary antenna receives and outputs an auxiliary video signal. The power amplifier has an input connected to the auxiliary antenna to receive and amplify the auxiliary video signal. The diplexor has first and second input terminals and an output terminal. The second input terminal is connected to the power amplifier and receives the amplified auxiliary video signal. The first input terminal is preferably connected to the satellite dish to receive the satellite video signal. The diplexor sums the amplified auxiliary signal and the satellite video signal and transmits the aggregate signal in a first direction to its output terminal. In addition, the output terminal of the diplexor preferably receives a power signal and transmits the power signal in a second direction, which is opposite to the first direction, via the first input to the power amplifier. The power signal is used to energize the power amplifier.

In further accordance with the present invention, the antenna subassembly includes a second diplexor, and first and second sensors for outputting, respectively, first and second satellite video signals. The second diplexor includes third and fourth input terminals and a second output terminal. The first and third input terminals are preferably connected to the first and second sensors to receive, respectively, the first and second satellite video signals. The power amplifier is connected to each of the second and fourth input terminals to apply thereto the amplified auxiliary video signal. Thus, the first and second diplexors transmit first and second aggregate signals in a first direction to the first and second output terminals, respectively. Preferably, at least one of the first and second output terminals receives a power signal and transmits the power signal in a second direction to the power amplifier, which energizes the power amplifier.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1A:
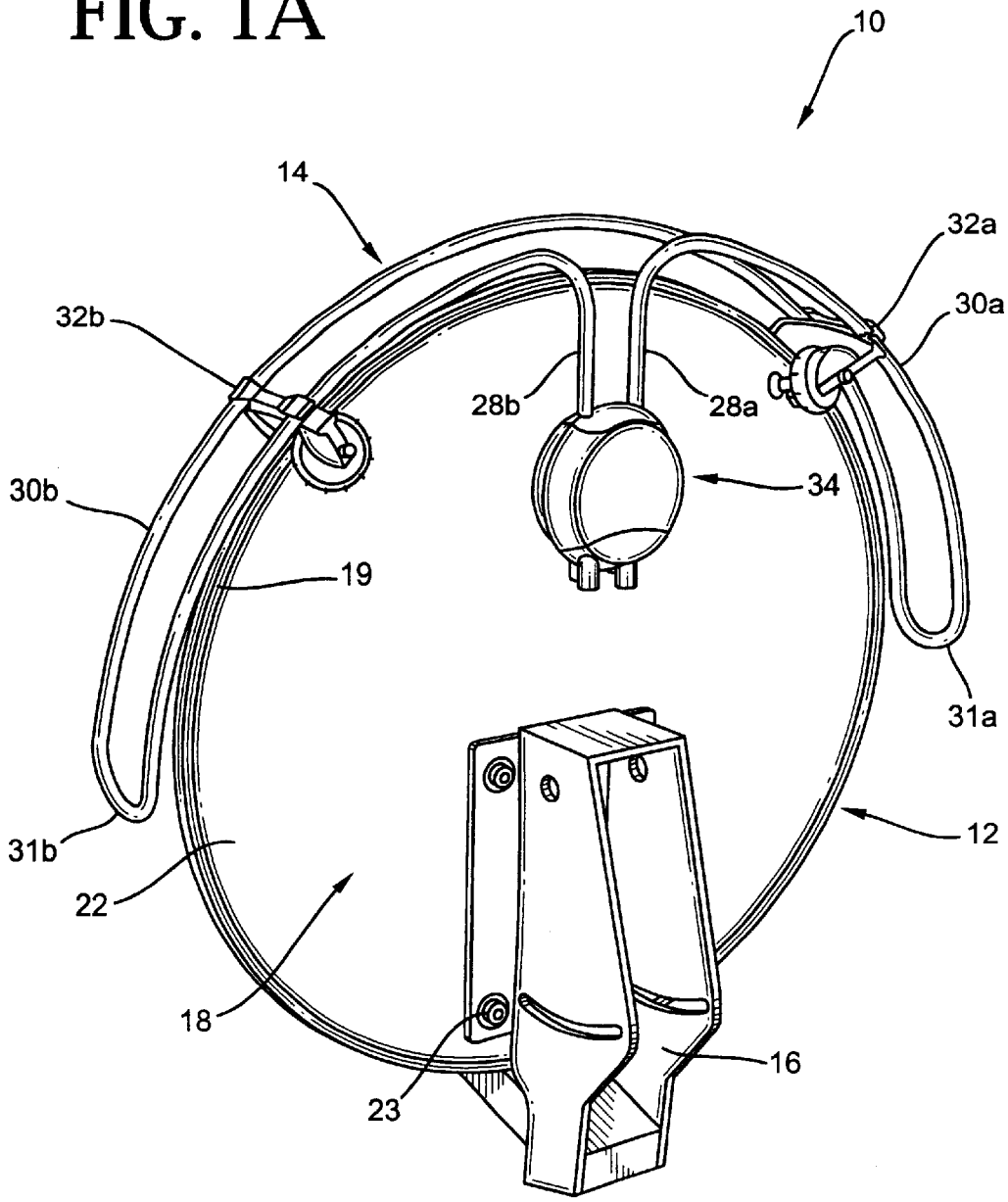
FIGS. 1A and 1B are rear and front perspective views, respectively, of an antenna assembly, which includes a dish antenna, an auxiliary antenna, and a device for mounting the auxiliary antenna to the dish antenna in accordance with the present invention.
Figure 1B:
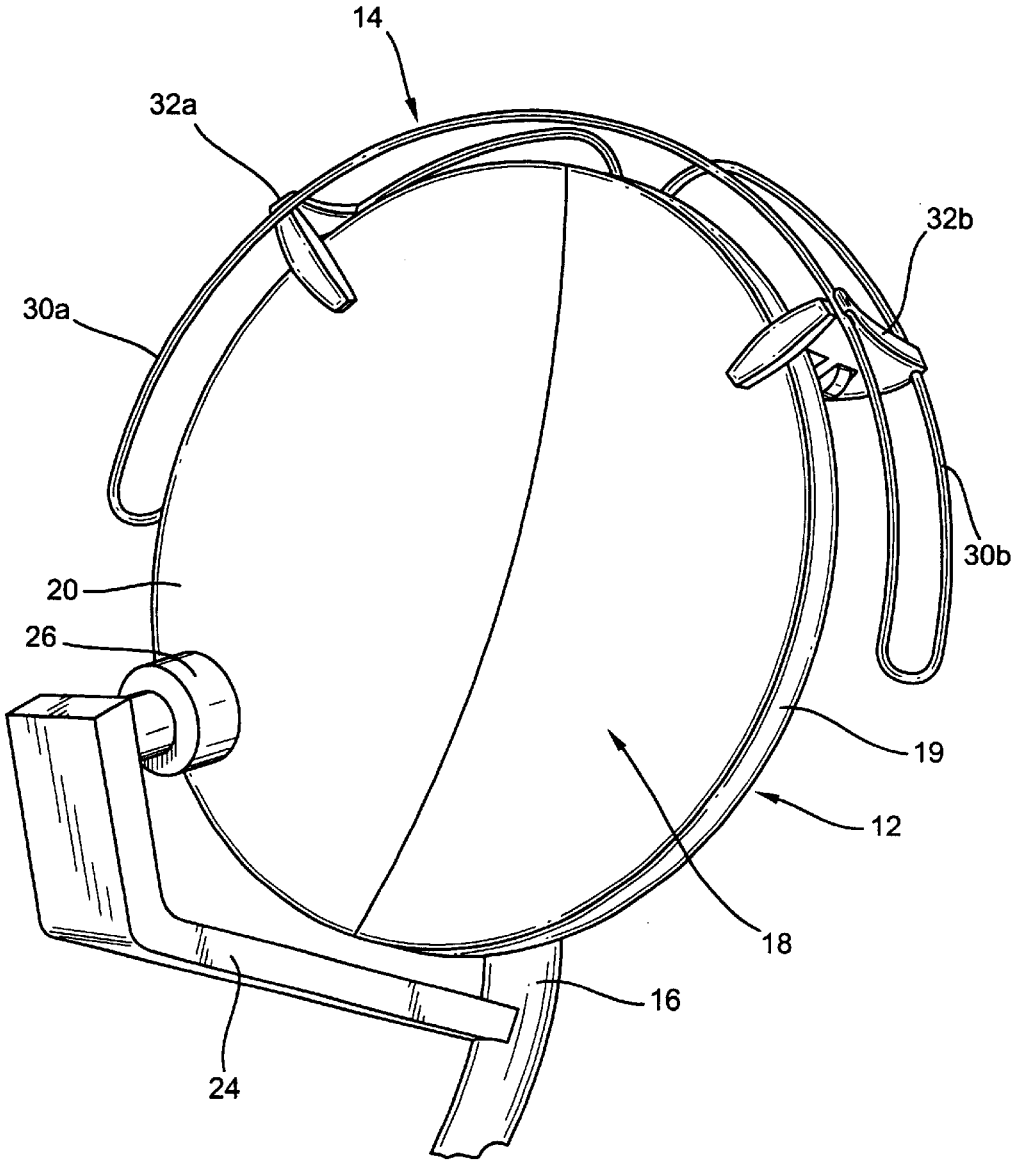

FIGS. 1A and 1B show an antenna assembly 10, which includes a reflector or dish antenna 12 for receiving television or video signals transmitted from satellites that are placed in a stationary or asynchronous orbit about the earth, and a second or auxiliary antenna 14 for receiving video signals from terrestrial or satellite transmitters. The antenna assembly includes at least one support 32 (either 32*a* and/or 32*b*) for mounting the auxiliary antenna 14 to the dish antenna 12. The first embodiment of the support 32 is shown in FIGS. 1A and 1B.

The antenna assembly 10 and, in particular, the dish antenna 12 is supported upon a base 16, which is fixedly secured to a structure, e.g., a residence, in which a television set is located. Preferably, the antenna assembly 10 is mounted to permit a line-of-sight orientation between the dish antenna 12 and the satellite from which the video signals are transmitted. The dish antenna 12 has a reflector or shell 18 with a concave shape that is well known in the art.

As illustrated in FIGS. 1A and 1B, the shell 18 has a periphery 19, which is substantially circular. The dish antenna 12 has a front, signal-receiving side 20, as shown in FIG. 1B, and a rear side 22, as shown in FIG. 1A. The base 16 is affixed to the rear side 22 by appropriate fasteners, such as nuts and bolts, which are collectively identified by reference numeral 23.

As shown in FIG. 1B, a support arm 24 is affixed to the base 16 and extends upwardly from the base 16 and forwardly of the front side 20 to support at least one sensor 26 at a focal point of the signals reflected from the front, signal-receiving side 20. In a first embodiment of the present invention that will be described with respect to FIG. 3A, a single sensor 26 is provided to receive and output a single satellite video signal, which is transmitted to a receiver for display by a television set. In a second embodiment that will be described with respect to FIG. 3B, first and second sensors 26*a* and 26*b* are mounted at the distal end of the support arm 24, which enable two satellite video signals to be transmitted by cable into the structure and viewed on two different television sets.

Still referring to FIGS. 1A and 1B, the auxiliary antenna 14 preferably includes a pair of dipoles 28*a* and 28*b*, each of which extends upwardly from a housing 34 in a substantially vertical direction, before being bent away from each other in opposite directions to form a pair of U-shaped arms 30*a* and 30*b*. Each of the arms 30*a* and 30*b* extends away from its associated dipole 28*a* or 28*b*. At the remote ends, each arm 30*a* and 30*b* is bent in a U-shaped curve 31*a* and 31*b* before extending back towards each other and being connected to the other arm. The first and second arms 30*a* and 30*b* are configured to follow the circular periphery 19 of the dish antenna 12. As shown in FIGS. 1A and 1B, the spacing between the first and second arms 30*a* and 30*b* and the periphery 19 is preferably maintained substantially equal.

At least one support 32 is interposed between the dish antenna 12 and the terrestrial antenna 14 to wholly support the terrestrial antenna 14 on the satellite dish antenna 12. As described above, the dish antenna 12 is mounted to the structure by the base 16. Thus, the antenna assembly formed in accordance with the present invention eliminates the need for a second base to mount and support the auxiliary antenna to the structure.

Further, the support 32 enables the auxiliary antenna 14 to be mounted to dish antennas of various dimensions and configurations. The support may be mounted to a variety of dish antennas having different sizes and configurations. For example, the support for the Sat-Trol Satellite Dish, which is manufactured by Braund Manufacturing Company located in Battle Creek, Mich., is not variably mounting in that its support is specifically adapted to mount satellite dish antennas of a particular configuration, that is, a dish with a cylindrically-shaped lip. The various embodiments of the support formed in accordance with the present invention can be mounted not only on the Sat-Trol dish antenna, but also on dish antennas manufactured by other companies.

Figure 2A:
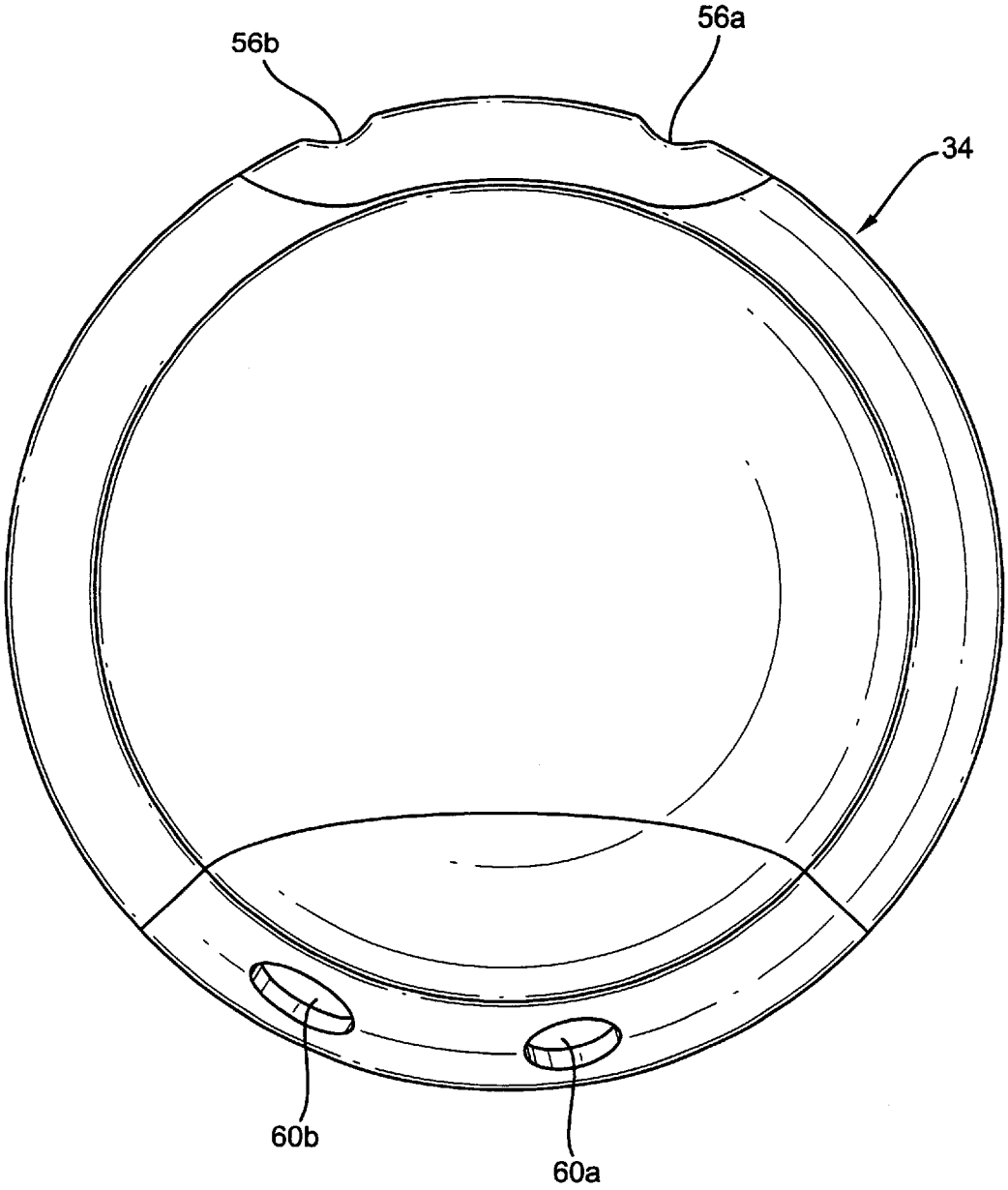
FIG. 2A is a top plan view of a housing for receiving signals from the dish antenna and the auxiliary antenna and combining the signals into an aggregate signal to be outputted to a television set.
Figure 2B:
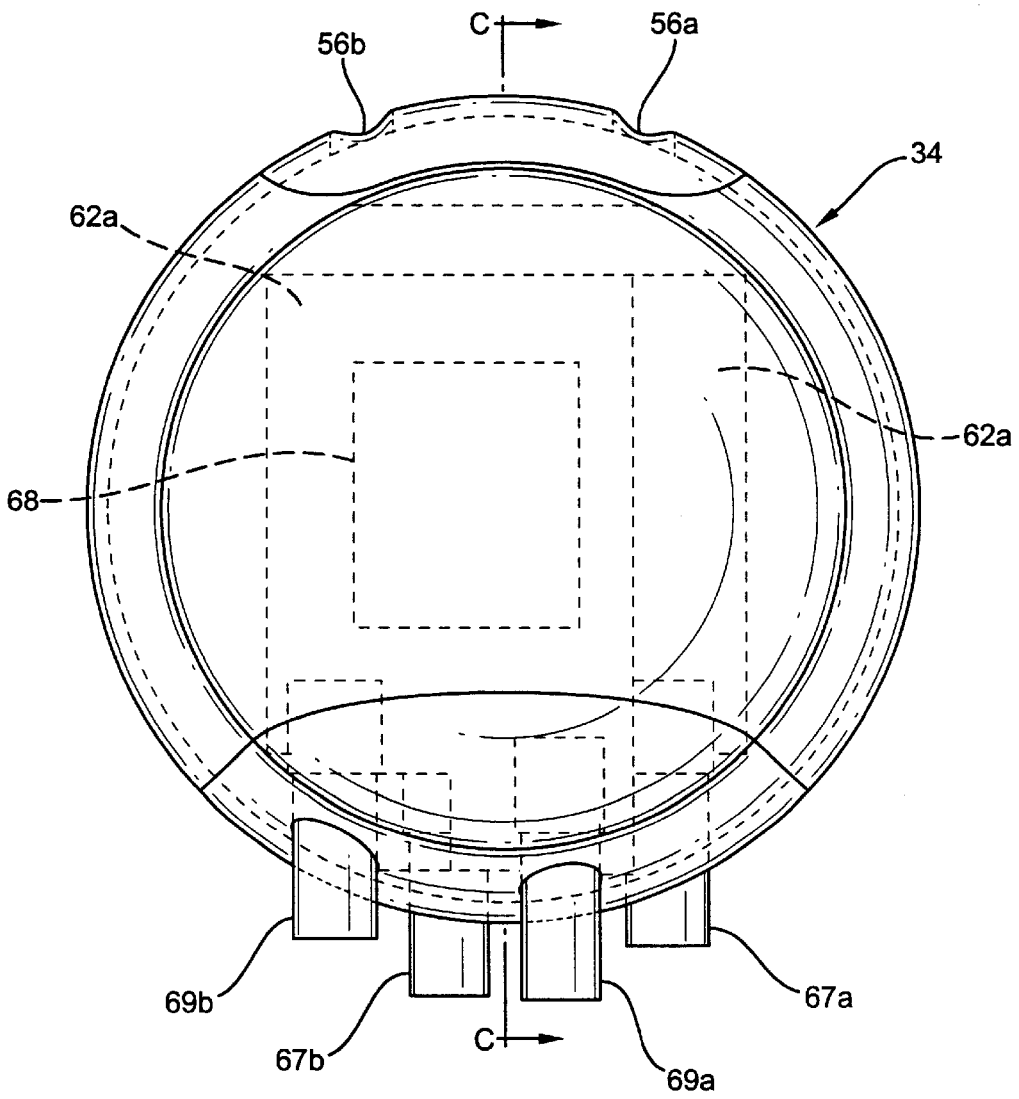
FIG. 2B is a detailed top view of the housing including hidden lines showing components enclosed within the housing shown in FIG. 2A.
Figure 2C:
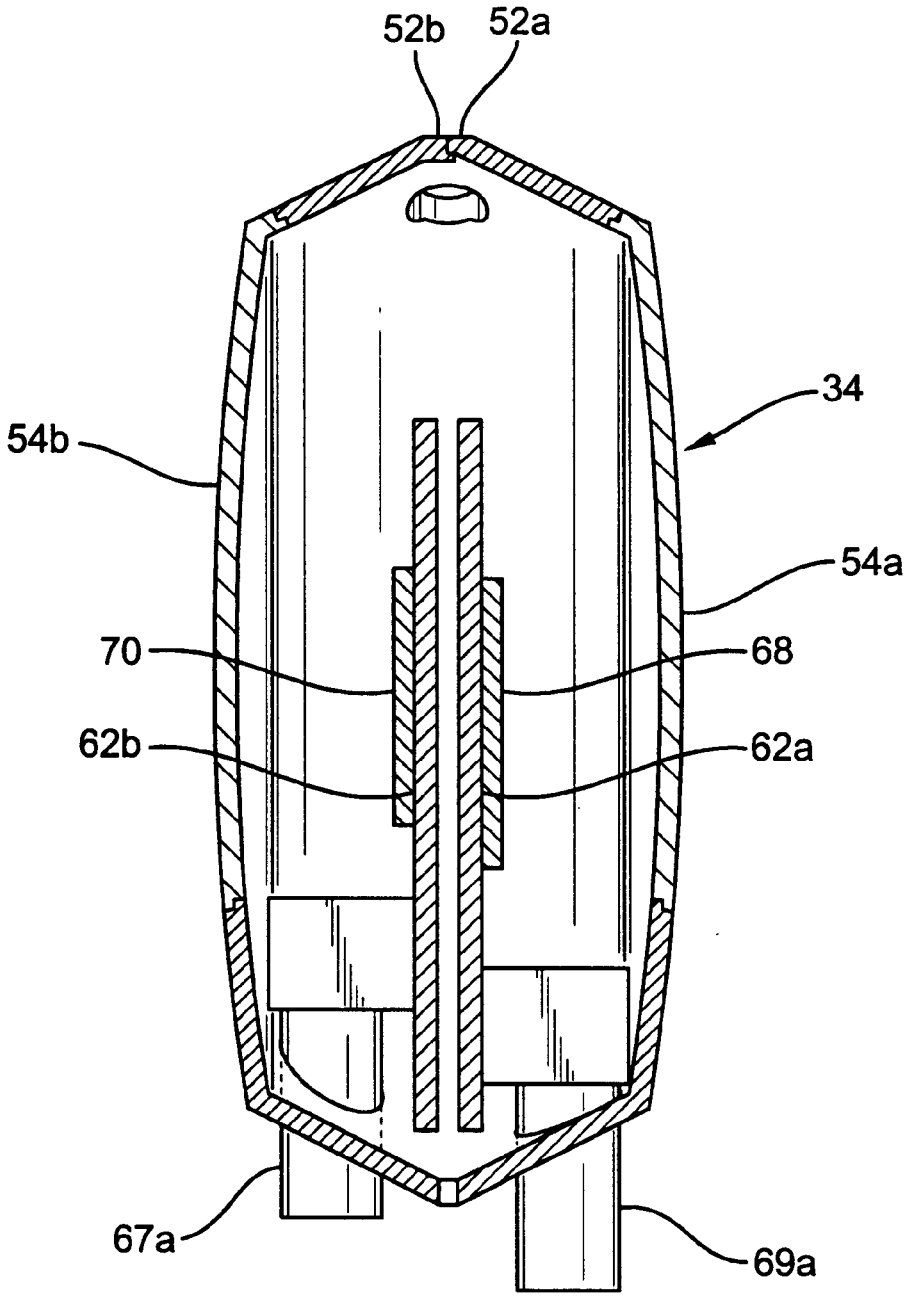
FIG. 2C is a side view of the housing sectioned along line C—C in FIG. 2B.

FIGS. 2A, 2B, and 2C show the housing 34 for enclosing diplexor circuitry 70 and amplifier circuitry 68 that receive television signals from the auxiliary antenna 14 and the dish antenna 12, and sum these signals together to provide an aggregate or composite signal to the television set. The housing 34, as best shown in FIG. 2C, includes first and second sections, 54*a* and 54*b*, which are configured to mate with each other along opposing edges 52*a* and 52*b*.

As shown in FIG. 2A, two openings 56*a* and 56*b* are disposed on the upper part of the housing 34 for receiving the first and second dipoles 28*a* and 28*b*. A pair of circuit boards 62*a* and 62*b* is mounted within the housing 34 by means well known in the art. As best shown in FIGS. 2B and 2C, inputs of the diplexor circuitry 70 on board 62*b* are connected to a pair of terminals 69*a* and 69*b*, and the outputs of the diplexor circuitry 70 on board 62*b* are connected to a pair of terminals 67*a* and 67*b*. Each of the input terminals 69*a* and 69*b* is a coaxial terminal, which is connectable via a coaxial cable to the sensor 26.

Figure 3A:
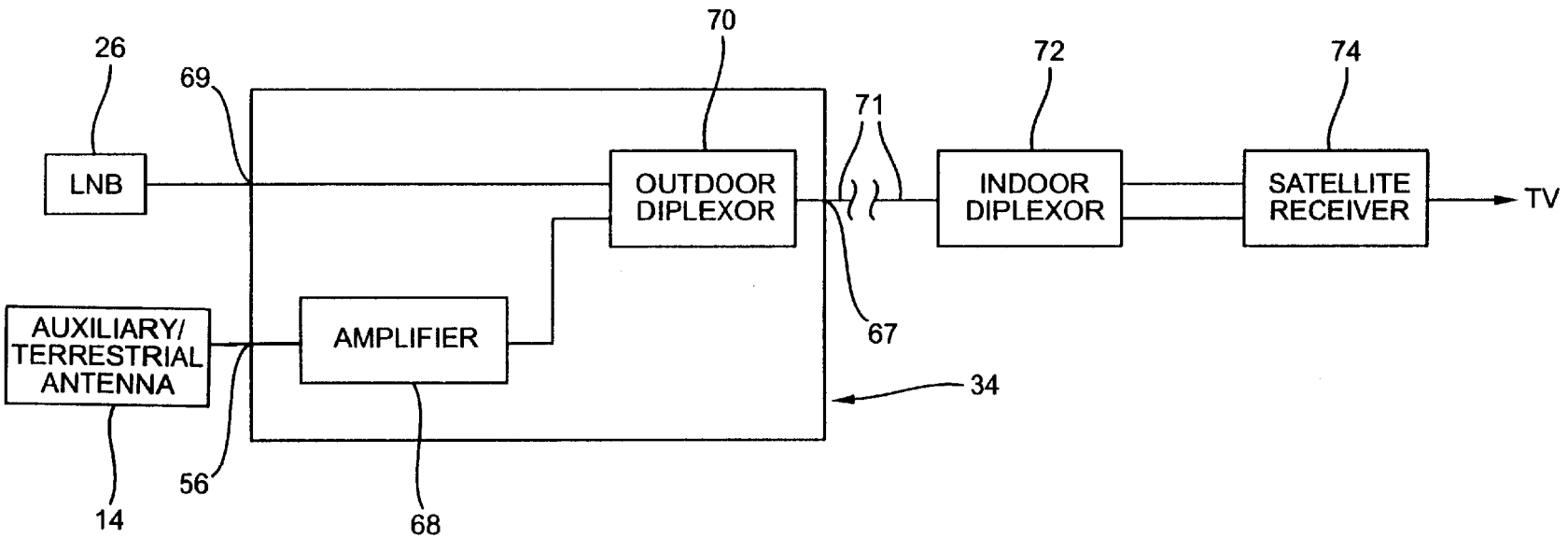
FIG. 3A is a block diagram of a first embodiment of a circuit for transmitting a composite signal from the dish antenna and the reflector antenna to a corresponding satellite receiver in accordance with the present invention.

FIG. 3A is a block diagram of a first embodiment of a circuit for transmitting via a single cable a composite auxiliary and satellite signal to a corresponding satellite receiver in accordance with the present invention. The sensor 26 is preferably a low-noise blocker (LNB). The output of the auxiliary antenna 14, i.e., that signal appearing across the dipoles 28*a* and 28*b*, is applied via openings 56 in the housing 34 to the amplifier 68, which amplifies it and, thereby, improves the fringe reception of the auxiliary signal. The satellite video signal is transmitted from the LNB 26 through the input terminal 69 to an input of the diplexor 70. The output of the amplifier 68 is applied to the remaining input of the diplexor 70.

As is well known in the art, the diplexor 70 sums the video signals from the auxiliary antenna 14 and the LNB 26. The summed signal is outputted to the output terminal 67. Only a single coaxial cable 71 is required to transmit the summed signal into the interior of the structure, on which the antenna assembly 10 is mounted, to be displayed by the television set. In particular, the coaxial cable is connected to an indoor diplexor 72, which separates the summed signals into satellite and auxiliary video signals that appear at corresponding outputs. Both of these outputs are then supplied to a satellite receiver 74, which detects and amplifies the signals before applying them to the television set.

The satellite receiver 74 supplies power to the amplifier 68 and the LNB 26 via a direct current (DC) voltage through the diplexors 70 and 72. The voltage appearing at the amplifier 68 preferably varies in the range of 13V to 18V. In order for the amplifier 68 to amplify the auxiliary video signal a controlled amount, it is preferable to regulate the voltage applied to the amplifier 68. A voltage regulator is preferably built into the amplifier 68 to provide a regulated voltage source, such as 12V, to energize the amplifier 68, and thus amplify the auxiliary signal by a substantially static, controlled amount. The circuit arrangement shown in FIG. 3A permits a simple and efficient installation of the antenna assembly 10, which requires only a single coaxial cable 71 connected between the assembly 10 and the indoor diplexor 72. The cable 71 transmits an energizing voltage to the amplifier 68 and the LNB 26 in a first direction, while transmitting the aggregate auxiliary and satellite video signal to the indoor diplexor 72 and the satellite receiver 74 in a second, opposite direction.

Figure 3B:
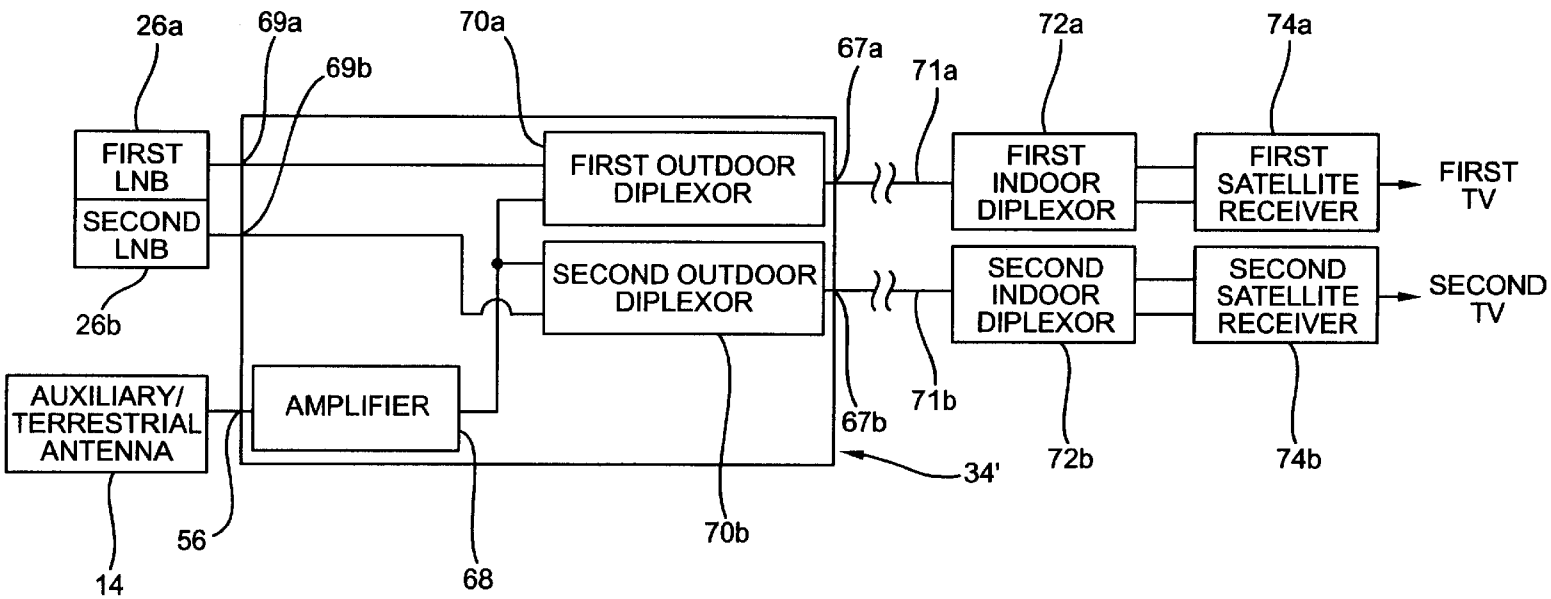
FIG. 3B is a block diagram of a second embodiment of the circuit for transmitting composite signals from the auxiliary antenna and two or more dish antennas to a pair of corresponding satellite receivers in accordance with the present invention.

FIG. 3B is a block diagram of a second embodiment of the circuit for transmitting via two cables composite auxiliary and satellite signals to a pair of corresponding satellite receivers in accordance with the present invention. A first LNB 26*a* and a second LNB 26*b* simultaneously receive and transmit two satellite video signals to be displayed on two television sets, which are typically located in different rooms within the structure. The first and second LNBs 26*a* and 26*b* apply, respectively, the satellite video signals via inputs 69*a* and 69*b* to one input of each of a first outdoor diplexor 70*a* and a second outdoor diplexor 70*b*. The auxiliary antenna 14 applies the auxiliary signal via the openings 56 of the housing 34' to the other inputs of the diplexors 70*a* and 70*b* via the amplifier 68.

The composite signals outputted by the diplexors 70*a* and 70*b* are connected, respectively, by the output terminals 67*a* and 67*b*, to their respective coaxial cables 71*a* and 71*b*. These cables are run from the antenna assembly 10 mounted on the structure to the television sets, typically in separate rooms, within the structure. The coaxial cables 71*a* and 71*b* are connected to indoor diplexors 72*a* and 72*b*, which separate the composite signals into satellite and auxiliary components and apply these signals to satellite receivers 74*a* and 74*b*. The configuration of circuitry within the housing 34' permits a single antenna assembly 10 to transmit two composite signals to separate television sets. Only two coaxial cables are needed to interconnect the assembly 10 and the television sets. Each of these two cables transmits power to the amplifier 68 and LNBs 26*a* and 26*b* in the first direction, and transmits composite video signals to separate television sets, on which separate programs may be viewed, in the second direction.

Figure 4:
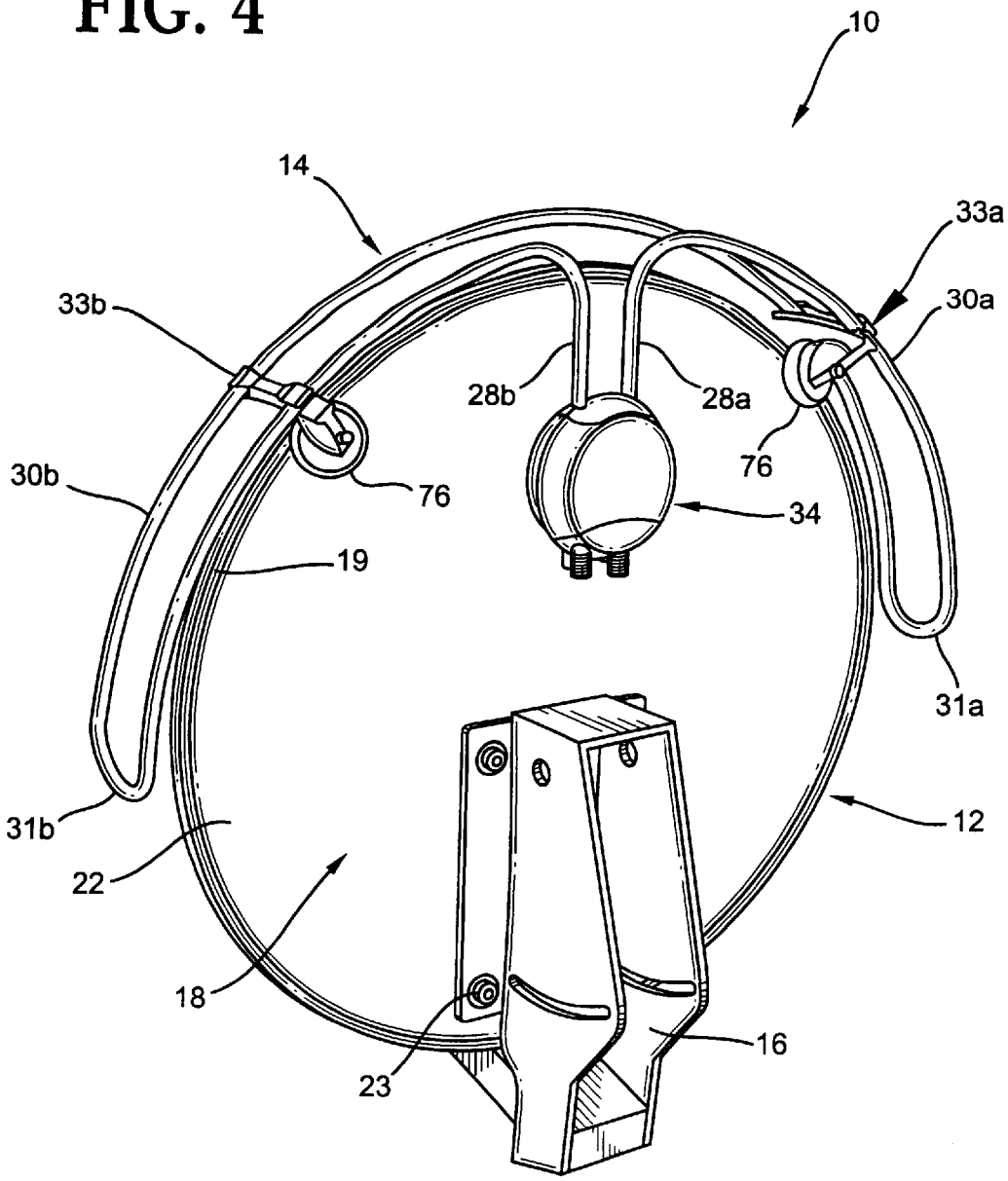
FIG. 4 is a rear perspective view of an antenna assembly, which includes a dish antenna, an auxiliary antenna, and a second embodiment of the device for mounting the auxiliary antenna to the dish antenna in accordance with the present invention.
Figure 5A:
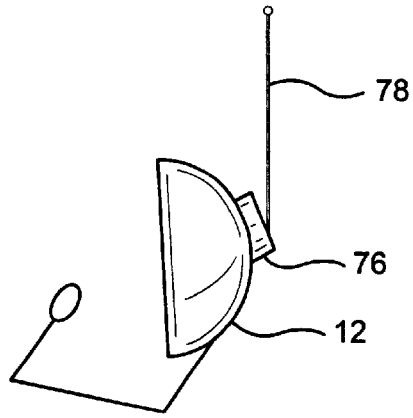
FIGS. 5A–5I are side views of antenna assemblies, each of which includes different types of auxiliary antennas and the second embodiment of the device for mounting the auxiliary antenna to the dish antenna in accordance with the present invention.
Figure 5B:
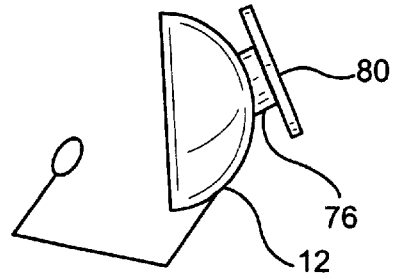
Figure 5C:
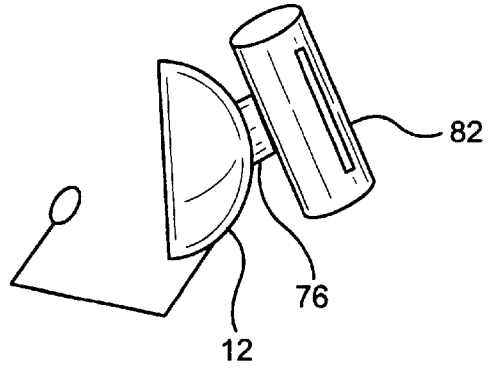
Figure 5D:
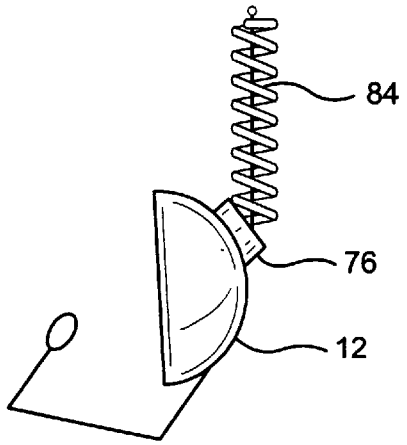
Figure 5E:
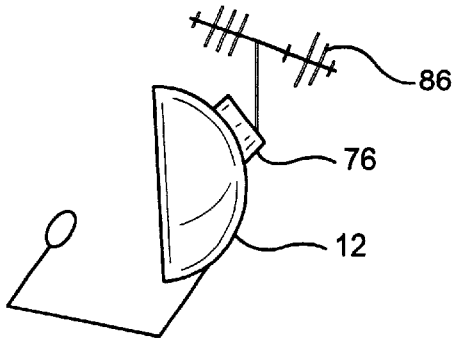
Figure 5F:
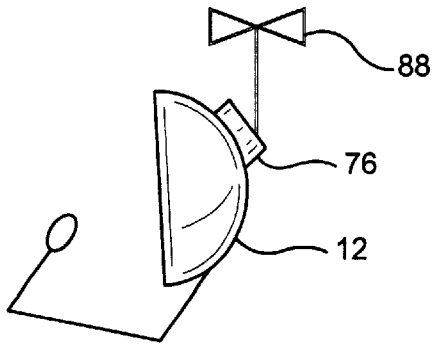
Figure 5G:
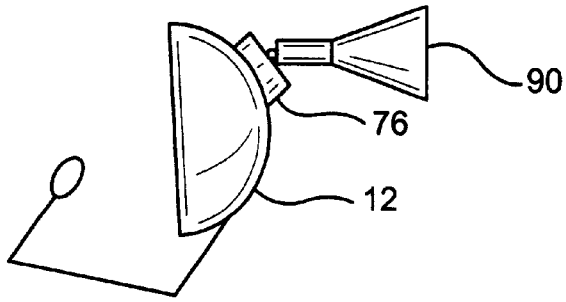
Figure 5H:
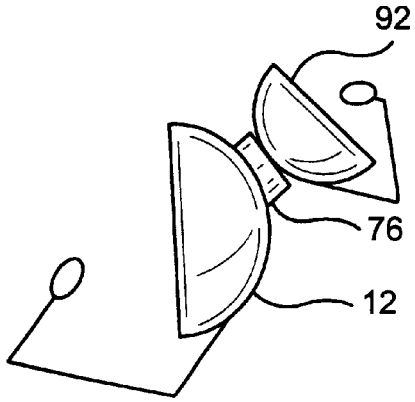
Figure 5I:
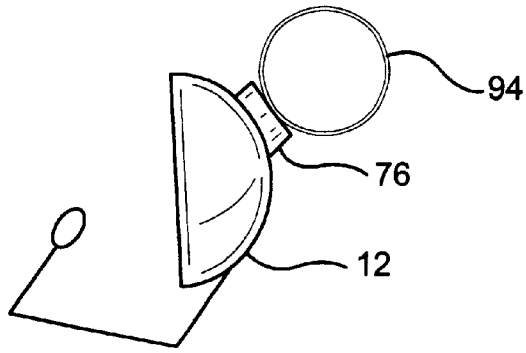
Figure 6:
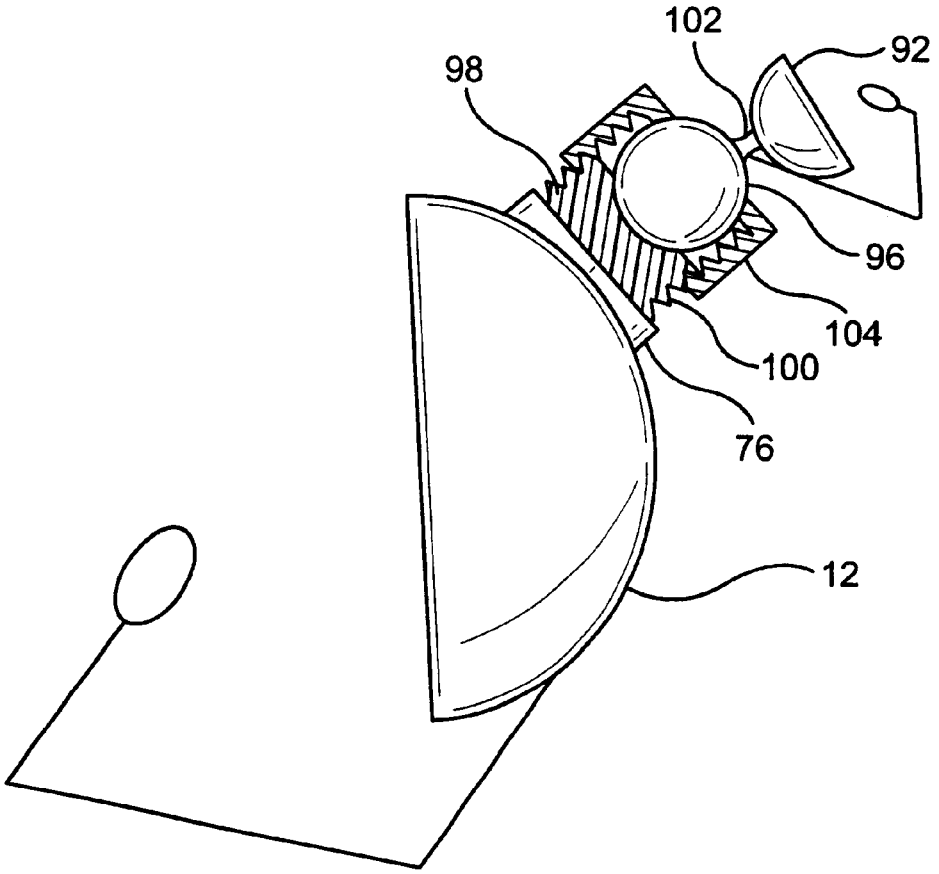
FIG. 6 is a side view of an antenna assembly showing a third embodiment of the device for mounting the auxiliary antenna to the dish antenna in accordance with the present invention.

A second embodiment of a support 33 (including 33*a* and/or 33*b*) formed in accordance with the present invention is shown in FIG. 4. The support 33 enables the auxiliary antenna 14, which is shown as a dipole in FIG. 4, to be magnetically mounted to dish antennas of various dimensions and configurations. The support 33 essentially includes a metallic, magnetic or magnetizable portion 76, which is or can be made responsive to magnetic attraction. The magnetic portion 76 is affixed to the auxiliary antenna 14, and thus supports the antenna 14 in the desired orientation with respect to the dish antenna 12.

Since the shell 18 of the dish antenna 12 is preferably also metallic, magnetic or manufactured from a manetizable substance, the magnetic portion 76, and thus the antenna 14 can be magnetically affixed to the dish antenna 12. In addition, the position and orientation of the antenna 14 with respect to the dish antenna 12 can easily be changed by the user to improve reception of terrestrial and/or satellite signals by the auxiliary antenna 14. As shown in FIGS. 5A–5I and 6, the shape of at least a part of the surface of the magnetic portion 76 is preferably manufactured to substantially conform to the contour of the shell 18. Such a shape reduces the strength of the magnetic force required to maintain the auxiliary antenna 14 in the desired location on the dish antenna 12, and thus the cost of manufacturing the support 33.

FIGS. 5A–5I show side views of antenna assemblies, each of which includes a different type of terrestrial and/or satellite auxiliary antenna. A whip (monopole) antenna 78; a planar, microstrip, or patch antenna 80; a slot antenna 82; a helical or coil antenna 84; a Yagi antenna 86; a trapezoidal or bow-tie antenna 88; a horn antenna 90; a dish or reflector antenna 92; and a loop antenna 94 are shown removably affixed via the magnetic portion 76 to the dish antenna 12 in FIGS. 5A–5I, respectively. The antennas shown are not intended to limit the present invention in any way, but are merely intended to illustrate the types of antennas that could be mounted to the dish antenna 12, which may additionally include a log-periodic antenna, a spiral antenna, an antenna array, a frequency-independent antenna, a zig-zag antenna, a circularly-polarized antenna, and any combination of two or more of any of the aforementioned antennas.

The various types of antennas are shown directly attached to the magnetic portion 76 in FIGS. 5A–5I. However, an adjustable mounting device, such as a captive-ball mount shown in FIG. 6, may be used to couple the auxiliary antenna to the magnetic portion 76 on the dish antenna 12. The captive-ball mount preferably includes a ball 96, which is seated against a deformable washer 98 within a hollow, threaded portion 100. The threaded portion 100 is preferably affixed to the magnetic portion 76. The ball 96 includes an arm 102 that couples the ball 96 to the auxiliary antenna, such as the second dish antenna 92 shown in FIG. 6. A nut 104, having threads along an inside circumference, is screwed onto the threaded portion 100. As the nut 104 is tightened, the ball 96 is depressed against the deformable washer 98 and the movement of both the ball 96 within the threaded portion 100, and thus the position and orientation of the auxiliary antenna 92 with respect to the dish antenna 12 are substantially fixed.

Figure 7A:
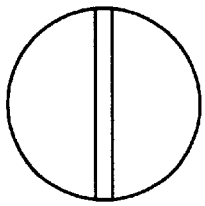
FIGS. 7A–7C are top plan views of alternative embodiments of a nut used in the third embodiment of the device for mounting the auxiliary antenna to the dish antenna in accordance with the present invention.
Figure 7B:
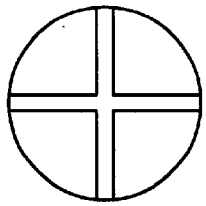
Figure 7C:
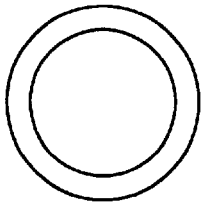

FIGS. 7A, 7B, and 7C show top plan views of alternative embodiments of the nut 104, which permit adjustment of the position of the auxiliary antenna 14 in one, two, and three planes, respectively. The captive-ball mount shown in FIG. 6 could readily be used to mount any of the auxiliary antennas mentioned above to the magnetic portion 76. In addition, it is anticipated that any of a variety of alternative mounting devices known in the art, for which the captive-ball mount is but one example, could be used to mount the auxiliary antenna 14 to the reflector antenna 12.

From the foregoing description, it will be appreciated that the apparatus and method formed in accordance with the present invention provide an antenna assembly in which one or more different types of satellite and/or terrestrial auxiliary antennas can be magnetically mounted to a dish antenna in user-selectable orientations with respect to the dish antenna. It is to be further appreciated that the antenna assembly can readily be mounted to and repositioned on an existing dish antenna and connected to its satellite receiver. It is still further to be appreciated that the antenna assembly can be connected to a satellite receiver using a minimum number of cables without requiring additional electrical and/or mechanical devices.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An antenna assembly, the antenna assembly comprising:

a dish antenna, the dish antenna including a reflector;

a mount, the mount being magnetically affixed to the reflector of the dish antenna; and an auxiliary antenna, the auxiliary antenna being affixed to the mount, thereby removably mounting the auxiliary antenna to the reflector of the dish antenna.

2. An antenna assembly as defined by claim 1, wherein the auxiliary antenna includes at least one of a Yagi antenna, bow-tie antenna, trapezoidal antenna, frequency-independent antenna, log-periodic antenna, spiral antenna, circularly-polarized antenna, planar antenna, microstrip antenna, patch antenna, horn antenna, whip antenna, helical antenna, coil antenna, loop antenna, dipole antenna, slot antenna, reflector antenna, zig-zag antenna, and an antenna array.

3. An antenna assembly as defined by claim 1, wherein a shape of the mount substantially conforms to a contour of the reflector.

4. An antenna assembly as defined by claim 1, wherein the reflector is at least one of metallic and capable of magnetic attraction.

5. An antenna assembly as defined by claim 1, wherein the mount is at least one of metallic and capable of magnetic attraction.

6. An antenna assembly as defined by claim 1, further including an adjustable mounting device, the adjustable mounting device being disposed between the mount and the auxiliary antenna, the adjustable mounting device being coupled to the mount, the auxiliary antenna being coupled to the adjustable mounting device.

7. An antenna assembly as defined by claim 6, wherein the adjustable mounting device enables movement of the auxiliary antenna in at least one plane, the adjustable mounting device being capable of selectively fixing a position of the auxiliary antenna with respect to the reflector.

8. An antenna assembly as defined by claim 6, wherein the adjustable mounting device includes a captive-ball mount.

9. An antenna assembly, the antenna assembly comprising:

a mount, the mount being magnetically attracted to a reflector of a dish antenna; and an auxiliary antenna, the auxiliary antenna being affixed to the mount.

10. An antenna assembly as defined by claim 9, wherein the auxiliary antenna includes at least one of a Yagi antenna, bow-tie antenna, trapezoidal antenna, frequency-independent antenna, log-periodic antenna, spiral antenna, circularly-polarized antenna, planar antenna, microstrip antenna, patch antenna, horn antenna, whip antenna, helical antenna, coil antenna, loop antenna, dipole antenna, slot antenna, reflector antenna, zig-zag antenna, and an antenna array.

11. An antenna assembly as defined by claim 9, wherein a shape of the mount substantially conforms to a contour of the reflector.

12. An antenna assembly as defined by claim 9, wherein the mount is at least one of metallic and capable of magnetic attraction.

13. An antenna assembly as defined by claim 9, further including an adjustable mounting device, the adjustable mounting device being disposed between the mount and the auxiliary antenna, the adjustable mounting device being coupled to the mount, the auxiliary antenna being coupled to the adjustable mounting device.

14. An antenna assembly as defined by claim 13, wherein the adjustable mounting device enables movement of the auxiliary antenna in at least one plane, the adjustable mounting device being capable of selectively fixing a position of the auxiliary antenna with respect to the reflector.

15. An antenna assembly as defined by claim 13, wherein the adjustable mounting device includes a captive-ball mount.

16. An antenna assembly, the antenna assembly comprising:

a first antenna, the first antenna including a reflector, the reflector having a front signal-receiving surface and a rear surface, at least a portion of the rear surface being at least one of metallic and magnetic;

at least one support, at least a portion of the at least one support being at least one of metallic and magnetically attracted to the portion of the rear surface being at least one of metallic and magnetic; and a second antenna, the second antenna being coupled to the at least one support, thereby enabling the second antenna to be removably affixed to the reflector.

17. An antenna assembly as defined by claim 16, wherein the second antenna includes at least one of a Yagi antenna, bow-tie antenna, trapezoidal antenna, frequency-independent antenna, log-periodic antenna, spiral antenna, circularly-polarized antenna, planar antenna, microstrip antenna, patch antenna, horn antenna, whip antenna, helical antenna, coil antenna, loop antenna, dipole antenna, slot antenna, reflector antenna, zig-zag antenna, and an antenna array.

18. An antenna assembly as defined by claim 16, wherein a shape of the portion of the at least one support being at least one of metallic and capable of magnetic attraction substantially conforms to a contour of the portion of the rear surface being at least one of metallic and capable of magnetic attraction.

19. An antenna assembly as defined by claim 16, wherein the reflector is substantially dish-shaped.

20. An antenna assembly as defined by claim 16, wherein the at least one support includes an adjustable mounting device, the adjustable mounting device being disposed between the at least one support and the second antenna, the adjustable mounting device being coupled to the at least one support, the second antenna being coupled to the adjustable mounting device.

21. An antenna assembly as defined by claim 20, wherein the adjustable mounting device enables movement of the second antenna in at least one plane, the adjustable mounting device being capable of selectively fixing a position of the second antenna with respect to the reflector.

22. An antenna assembly as defined by claim 20, wherein the adjustable mounting device includes a captive-ball mount.

23. A method of mounting an auxiliary antenna to a dish antenna, the method comprising the steps of:

affixing magnetically at least one support to a reflector of the dish antenna, the reflector having a front signal-receiving surface and a rear surface, at least a portion of the rear surface being at least one of metallic and magnetic, at least a portion of the at least one support being at least one of metallic and magnetically attracted to the portion of the rear surface being at least one of metallic and magnetic; and affixing the auxiliary antenna to the at least one support, thereby enabling the auxiliary antenna to be removably affixed to the dish antenna.

24. A method of mounting an auxiliary antenna to a dish antenna as defined by claim 23, further including the step of conforming a shape of the portion of the at least one support substantially to a contour of the portion of the rear surface.

25. A method of mounting an auxiliary antenna to a dish antenna as defined by claim 23, further including the step of coupling an adjustable mounting device between the at least one support and the auxiliary antenna, the adjustable mounting device enabling movement of the auxiliary antenna in at least one plane, the adjustable mounting device being capable of selectively fixings a position of the auxiliary antenna with respect to the reflector.

* * * * *